US009056214B2

(12) United States Patent
Barmoav et al.

(10) Patent No.: US 9,056,214 B2
(45) Date of Patent: Jun. 16, 2015

(54) WATERING DEVICE EQUIPPED WITH A DEFLECTOR HAVING AN UNEVEN SURFACE

(75) Inventors: Felix Barmoav, Rishon Lezion (IL); Haim Slotin, Oranit (IL)

(73) Assignee: Sovi Square Ltd., Rishon Leziyon (IL)

( * ) Notice: Subject to any disclaimer, the term of this patent is extended or adjusted under 35 U.S.C. 154(b) by 268 days.

(21) Appl. No.: 13/585,626

(22) Filed: Aug. 14, 2012

(65) Prior Publication Data

US 2013/0043327 A1 Feb. 21, 2013

Related U.S. Application Data

(60) Provisional application No. 61/523,598, filed on Aug. 15, 2011, provisional application No. 61/536,008, filed on Sep. 18, 2011, provisional application No. 61/591,925, filed on Jan. 29, 2012, provisional application No. 61/591,927, filed on Jan. 29, 2012.

(51) Int. Cl.

| | |
|---|---|
| ***F23D 11/04*** | (2006.01) |
| ***A62C 31/02*** | (2006.01) |
| *A62C 37/08* | (2006.01) |

(52) U.S. Cl.
CPC *A62C 31/02* (2013.01); *A62C 37/08* (2013.01)

(58) Field of Classification Search
USPC ..... 239/200, 201, 203, 204, 205, 214, 239/222.11, 223, 224, 461, 498, 513, 522, 239/523
See application file for complete search history.

(56) References Cited

U.S. PATENT DOCUMENTS

| | | | |
|---|---|---|---|
| 1,510,930 | A | 10/1924 | Enell |
| 1,593,918 | A | 7/1926 | Stanton |
| 1,618,538 | A | 2/1927 | Kittinger |
| 1,726,490 | A | 8/1929 | Irving et al. |
| 1,766,514 | A | 6/1930 | Henry |
| 1,799,243 | A | 4/1931 | Miller |
| 1,827,961 | A | 10/1931 | Thompson |
| 1,862,381 | A | 6/1932 | Le Moon |
| 1,881,409 | A | 10/1932 | Le Moon |
| 1,882,922 | A | 10/1932 | Robinson |
| 1,931,761 | A | 10/1933 | Hertel |
| 1,938,838 | A | 12/1933 | Jacobson |
| 1,962,824 | A | 6/1934 | Lindquist |
| 2,048,125 | A | 7/1936 | Irving |
| 2,076,753 | A | 4/1937 | Thompson |
| 2,128,552 | A | 8/1938 | Rader |
| 2,434,767 | A | 1/1948 | Hertel |

(Continued)

OTHER PUBLICATIONS

Patent Cooperation Treaty: PCT International Search Report including "Written Opinion of the International Searching Authority" (PCT Rule 43bis.1) for the corresponding International Patent Application No. PCT/US2012/050801; Date of Mailing: Dec. 27, 2012.

*Primary Examiner* — Justin Jonaitis
(74) *Attorney, Agent, or Firm* — M&B IP Analysts, LLC

(57) ABSTRACT

A watering device for irrigation of non-circular areas is disclosed. The watering device comprises a deflector having an uneven curved surface designed to cause liquid meeting the deflector to reach a distance that changes respective of the uneven surface to cover an irrigation area; a spiral sector object connected to the deflector and providing an adjustable spray orifice for adjusting an irrigation pattern of the watering device; and a two-diameter tubular body connected to the spiral sector object and allowing the liquid to flow from a pipe to the uneven curved surface of the deflector.

14 Claims, 17 Drawing Sheets

(56) References Cited

U.S. PATENT DOCUMENTS

| | | | | |
|---|---|---|---|---|
| 2,475,537 | A | 7/1949 | Ashworth | |
| 2,571,763 | A | 10/1951 | Robbins | |
| 2,601,559 | A | 6/1952 | Riblet | |
| 2,935,266 | A | 5/1960 | Coleondro et al. | |
| 2,943,798 | A | 7/1960 | Rienks | |
| 2,954,171 | A | 9/1960 | Hruby, Jr. | |
| 2,999,643 | A | 9/1960 | Kennedy | |
| 3,006,558 | A | 10/1961 | Jacobs | |
| 3,029,030 | A * | 4/1962 | Dey, Sr. | 239/520 |
| 3,095,148 | A | 6/1963 | Smith | |
| 3,362,641 | A | 1/1968 | Barnes | |
| 3,398,894 | A | 8/1968 | D'Agaro | |
| 3,452,930 | A | 7/1969 | Karbo | |
| 3,940,066 | A | 2/1976 | Hunter | |
| 4,079,762 | A | 3/1978 | Hanson, Jr. | |
| 4,154,404 | A | 5/1979 | Clawson | |
| 4,189,099 | A | 2/1980 | Bruninga | |
| D276,453 | S | 11/1984 | DeVroom | |
| D276,743 | S | 12/1984 | Clivio et al. | |
| 4,579,285 | A | 4/1986 | Hunter | |
| 4,580,729 | A | 4/1986 | Pounder | |
| 4,625,917 | A | 12/1986 | Torney | |
| D293,815 | S | 1/1988 | Scott et al. | |
| D299,156 | S | 12/1988 | Heren | |
| 4,834,292 | A | 5/1989 | Dyck | |
| D319,489 | S | 8/1991 | Han et al. | |
| 5,083,709 | A | 1/1992 | Iwanowski | |
| 5,205,491 | A | 4/1993 | Hadar | |
| 5,226,602 | A | 7/1993 | Cochran et al. | |
| 5,267,689 | A | 12/1993 | Forer | |
| 5,322,223 | A | 6/1994 | Hadar | |
| 5,556,036 | A * | 9/1996 | Chase | 239/457 |
| 5,669,449 | A | 9/1997 | Polan et al. | |
| 5,829,532 | A | 11/1998 | Meyer et al. | |
| 6,145,758 | A | 11/2000 | Ogi et al. | |
| 6,223,999 | B1 | 5/2001 | Lemelshtrich | |
| 6,443,372 | B1 * | 9/2002 | Hsu | 239/457 |
| D473,284 | S | 4/2003 | Pong | |
| D473,286 | S | 4/2003 | Bonzer | |
| 6,799,732 | B2 | 10/2004 | Sirkin | |
| 6,820,825 | B1 | 11/2004 | Wang | |
| 6,899,285 | B2 | 5/2005 | Goettl et al. | |
| 6,976,543 | B1 | 12/2005 | Fischer | |
| D516,669 | S | 3/2006 | Antonucci et al. | |
| 7,429,005 | B2 | 9/2008 | Schapper et al. | |
| 7,581,687 | B2 | 9/2009 | Feith et al. | |
| 7,584,802 | B1 | 9/2009 | Fischer | |
| 7,621,467 | B1 | 11/2009 | Garcia | |
| D616,962 | S | 6/2010 | Allen et al. | |
| 7,988,071 | B2 | 8/2011 | Bredberg | |
| 8,122,969 | B1 | 2/2012 | Fischer | |
| 8,366,020 | B2 | 2/2013 | Wang et al. | |
| 2002/0130202 | A1 | 9/2002 | Kah, Jr. et al. | |
| 2002/0153434 | A1 * | 10/2002 | Cordua | 239/457 |
| 2004/0108391 | A1 * | 6/2004 | Onofrio | 239/201 |
| 2005/0161534 | A1 | 7/2005 | Kah, Jr. et al. | |
| 2007/0267516 | A1 | 11/2007 | Feith et al. | |
| 2008/0169363 | A1 * | 7/2008 | Walker | 239/457 |
| 2009/0008484 | A1 | 1/2009 | Feith et al. | |
| 2009/0108088 | A1 | 4/2009 | Bredberg | |
| 2010/0038444 | A1 | 2/2010 | Coppersmith | |
| 2010/0065656 | A1 | 3/2010 | Grant | |
| 2011/0024526 | A1 | 2/2011 | Feith et al. | |

* cited by examiner

WATERING DEVICE EQUIPPED WITH A DEFLECTOR HAVING AN UNEVEN SURFACE

CROSS REFERENCE TO RELATED APPLICATION

This application claims the benefit of U.S. provisional application No. 61/523,598 filed Aug. 15, 2011, U.S. provisional application No. 61/536,008 filed Sep. 18, 2011, U.S. provisional application No. 61/591,925, filed Jan. 29, 2012, and U.S. provisional application No. 61/591,927 filed Jan. 29, 2012. The contents of each of the above-referenced provisional applications are herein incorporated by reference.

TECHNICAL FIELD

The present invention generally relates to watering devices used for irrigation, and more particularly, to watering devices for irrigating non-circular or semi non-circular areas.

BACKGROUND

Spray type sprinklers are well known in the art of irrigation and are typically used for irrigating lawns and gardens of both residential and industrial properties. Most of the sprinklers provide various degrees of coverage of areas where typically the water spray pattern covers a circle or semi-circle coverage in a fan-type of spray.

Circular spraying around the sprinkler requires large overlapping between each sprinkler to cover an area with appropriate coverage. Therefore, circular spraying solutions end up with either wasting water or under watering, as certain areas are not covered by the sprinkler system. There are certain attempts to provide solutions for non-circular shapes, particularly rectangles. However, these solutions are complex and far from providing appropriate coverage. This is shown in FIG. 1A in diagram 100A where a sprinkler 110 is configured to irrigate a square area 100. It is adjusted such that the sprinkler 110 irrigates on a diameter equal to the length of the rectangular using spraying lines 140. As shown in FIG. 1, the irrigated area 120 is smaller than the area of the square 100; this leaves several non-irrigated areas 130, resulting in under irrigation. Conversely, in the case shown in FIG. 1B, the sprinkler 110 is configured to sprinkle on the diagonal of the square 100. As a result, the entire square area is irrigated. However, additional areas 150 are irrigated as well resulting in over irrigation and waste of water.

FIGS. 2A and 2B show attempts to provide better coverage using sprinklers 210 that allow not only adjusting the sprinkling radius, but also the angle of coverage. Specifically, in this case shown in FIGS. 2A and 2B the angle of coverage is 90 degrees for each sprinkler 210. In the case depicted in FIG. 2A, there is under irrigation of areas 230 while in the case depicted in FIG. 2B, there is an over irrigation of areas 250. Thus, none of these situations are desirable.

As a result of the deficient circular and semi-circular sprinkler solutions, there have been attempts to irrigate using various rectangular sprinkling solutions. The solutions discussed in the related art are mostly based on the use of moving parts, are complex to operate, have a relatively low reliability and are high in cost. Moreover, none of the prior art solutions deal effectively with odd shaped areas that require irrigation. Sprinklers that irrigate square and partially square surfaces exist, but they cannot be adjusted and their irrigation surfaces, as determined during the manufacturing process, are permanent. These permanent irrigation patterns might cause over or under irrigation of an area as specified above.

It would be therefore advantageous to provide a solution where a sprinkler can be adjusted to cover a predetermined area pattern that is not a circle or semi-circle. It would be further advantageous if such a solution does not require the use of moving parts.

SUMMARY

Certain embodiments disclosed herein include a watering device for irrigation of non-circular areas. The watering device comprises a deflector having an uneven curved surface designed to cause liquid meeting the deflector to reach a distance that changes respective of the uneven surface to cover an irrigation area; a spiral sector object connected to the deflector and providing an adjustable spray orifice for adjusting an irrigation pattern of the watering device; and a two-diameter tubular body connected to the spiral sector object and allowing the liquid to flow from a pipe to the uneven curved surface of the deflector.

Certain embodiments disclosed herein also include a watering device for irrigating of non-circular areas that comprises a deflector having a lateral surface determined by a radius that changes around a height axis of the deflector, the lateral surface having at least a first angle that determines a first irrigation distance from the center of the deflector for deflection of water hitting the deflector and a second angle that determines a second irrigation distance from the center of the deflector for deflection of water hitting the deflector; and an adjustable rectangular spray orifice for adjusting a non-circular irrigation pattern from an angle 0 degrees up to approximately 360 degrees.

Certain embodiments disclosed herein also include a deflector that comprises a high-angled deflection surface defined by at least one peak angle; and a low-angled deflection surface defined by at least one deep angle, such that when liquid hits the high-angled deflection surface, the liquid is deflected to a minimum distance from the deflector, and when the liquid hits the low-angled deflection surface, the liquid is deflected to a maximum distance from the deflector.

BRIEF DESCRIPTION OF THE DRAWINGS

The subject matter that is regarded as the invention is particularly pointed out and distinctly claimed in the claims at the conclusion of the specification. The foregoing and other objects, features, and advantages of the invention will be apparent from the following detailed description taken in conjunction with the accompanying drawings.

DETAILED DESCRIPTION

Figure 1A:
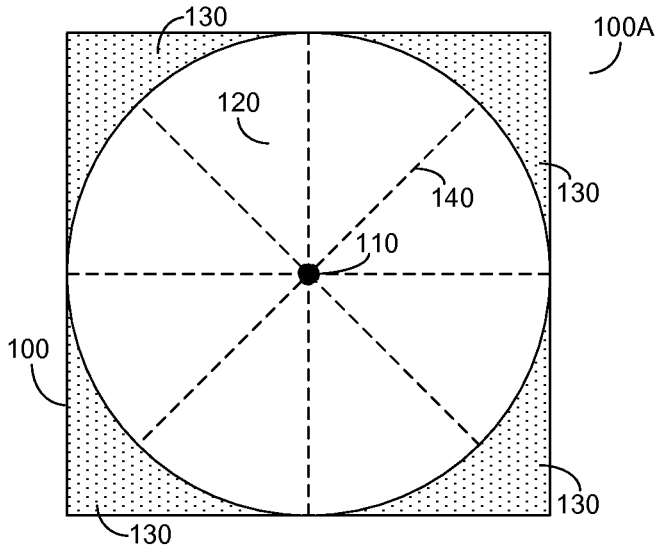
Figure 1A (PRIOR ART)
FIG. 1A is a diagram of a square area with a sprinkler at its center having a radius coverage along the length of the square resulting in under irrigation.
Figure 1B:
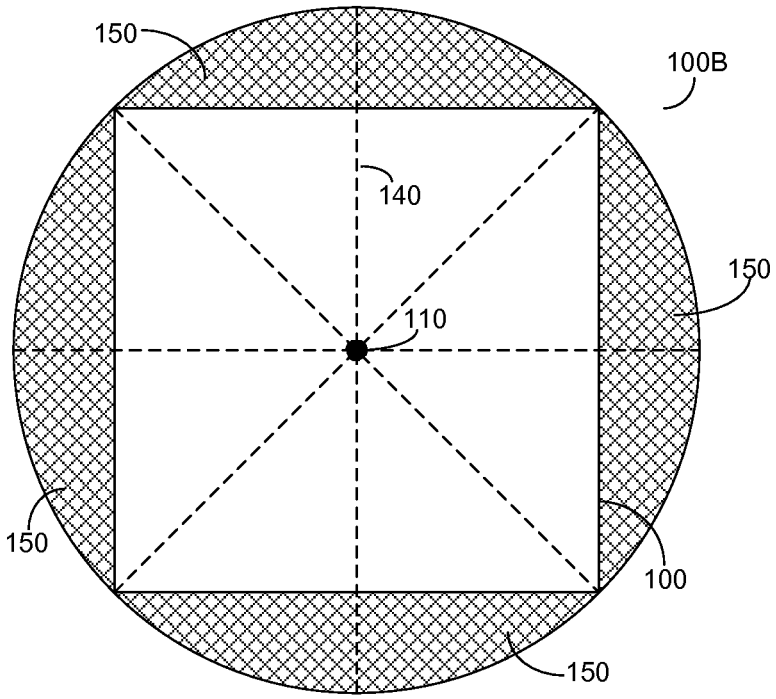
Figure 1B (PRIOR ART)
FIG. 1B is a diagram of a square area with a sprinkler at its center having a radius coverage along the diagonal of the square resulting in over irrigation.
Figure 2A:
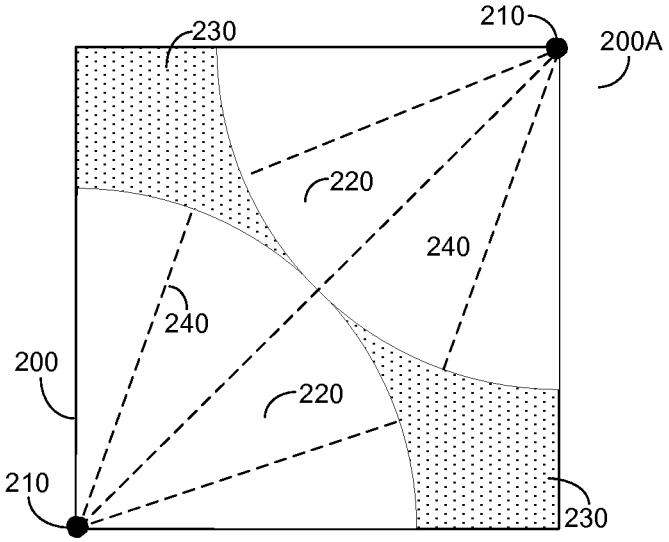
FIGURE 2A (PRIOR ART)
FIG. 2A is a diagram of a square area with two sprinklers placed at opposite corners of the square, each having a watering radius to the center of the square and a 90 degrees sprinkling limit resulting in under irrigation.
Figure 2B:
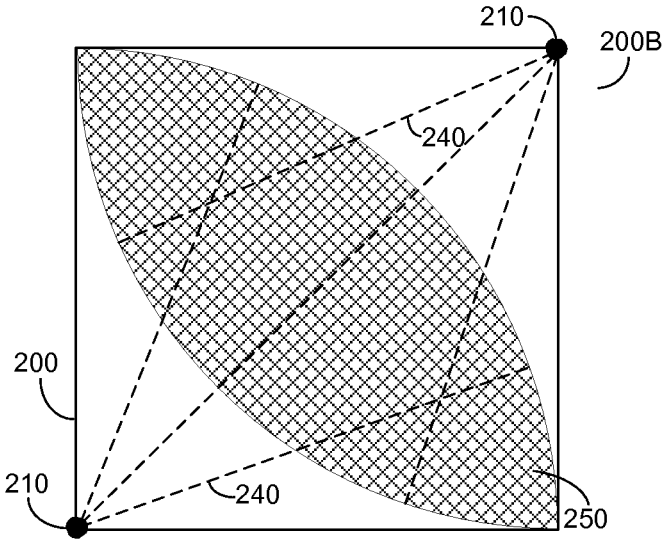
FIGURE 2B (PRIOR ART)
FIG. 2B is a diagram of a square area with sprinklers placed at opposite corners of the square, each having a watering radius close to the corner of the square and a 90 degrees sprinkling limit resulting in over irrigation.

The embodiments disclosed herein are only examples of the many possible advantageous uses and implementations of the innovative teachings presented herein. In general, statements made in the specification of the present application do not necessarily limit any of the various claimed inventions. Moreover, some statements may apply to some inventive features but not to others. In general, unless otherwise indicated, singular elements may be in plural and vice versa with no loss of generality. In the drawings, like numerals refer to like parts through several views.

Various exemplary embodiments disclosed herein include a watering device for irrigation of a non-circular or semi non-circular area. The watering device comprises a deflector having essentially the shape of a cone; the lateral surface of the deflector is determined by a radius that changes as it rotates about its center. While a cone is a geometric shape that tapers smoothly from its base to a point called the apex or vertex, the deflector's modified cone tapers unevenly to the apex or vertex. The irrigation radius can be changed according to an equation that determines the liquid deflection that hits the deflector from a tubular pipe coupled thereto. As a result of the deflector's different angles on the lateral surface, the liquid is distributed at variable distances from the deflector's center. Therefore, the watering device allows the irrigation of non-circular or semi non-circular areas. In one exemplary embodiment, the deflector has a variable radius with respect to its base and therefore provides liquid (e.g., water) coverage without unnecessary waste for both regular shaped areas (e.g., ovals, rectangles, parallelograms, trapezes, pentagons, hexagons, and the like) as well as irregular shaped areas.

Figure 3A:
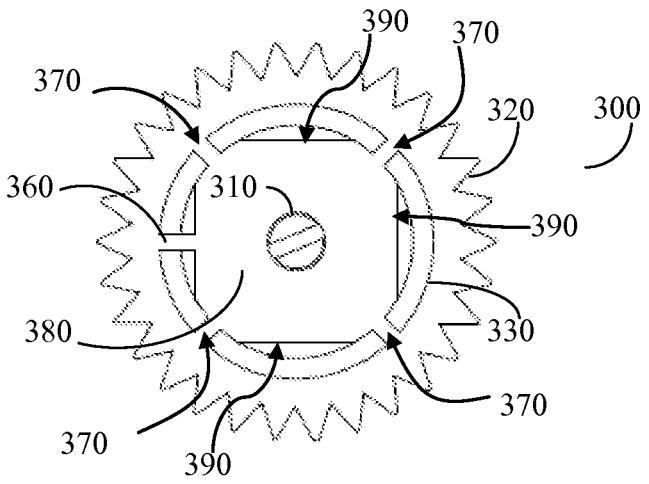
FIG. 3A is a schematic diagram of a top view of a deflector having an uneven surface according to one embodiment disclosed herein.

FIGS. 3A through 3H depict various exemplary and non-limiting views and cross sections of a deflector 300 constructed according to one embodiment. FIG. 3A depicts an exemplary and non-limiting schematic diagram of a top view of the deflector 300 that has an uneven surface according to one embodiment. A screw hole 310 is located in the middle of the top part of the deflector 300. The screw hole includes threads (ribs) used for attaching the deflector 300 to its lower portions by an easy gripped cog-wheel 320. The deflector 300 is further equipped with curves 330 used for spraying the mid area distances.

Figure 3B:
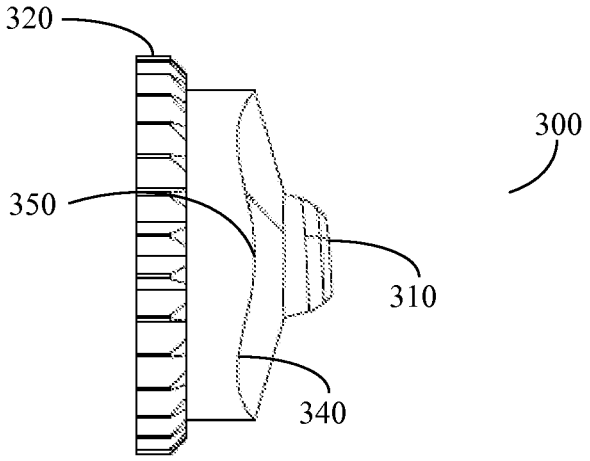
FIG. 3B is a schematic diagram of a side assembly view of a deflector having an uneven surface according to an embodiment disclosed herein.

The deflector 300 also includes an indicator 360 that indicates to a user as to where to start to open the orifice, four corners 370 which determine a rectangular shape of the irrigation area, and a spray head indicator 380 utilized to set the shape of the irrigation areas, e.g., a square, a rectangle, or a triangle, and so on. The edges of a rectangular spray head are labeled as 390. FIG. 3B depicts an exemplary and non-limiting schematic diagram of a side assembly view of the deflector 300 according to an embodiment. The deflector 300 includes an uneven curved surface that is partially deep angled 340 and peak angled 350. Essentially the deflector 300 has a cone shaped radius relative to the lateral surface of a cone that changes as it revolves around the center height of the cone. This results in the uneven curved surface. In another embodiment, the surface of the deflector 300 gradually inclines. It should be understood that once a full circle is completed, there will be a step where discontinuity of the surface occurs. It should be further understood that a discontinuity step may occur by having additional steps as the surface inclines, and at such discontinuities the surface may also decline. In yet another embodiment, a plurality of surfaces around a center exists with a discontinuity between each surface such that a staggered step-like cross-section is observed.

It is important to emphasize that the number and location of deep angles 340 and peak angles 350 can vary depending on a configuration of the watering device and the watering applications and need not even be at identical distance from each other (i.e., no symmetry is required). However, if the distances are equal, then watering coverage for shapes such as triangles, squares, pentagons, hexagons, etc. may be reached. Furthermore, if there is a variance in different peak angles 350 and/or different deep angles 340, as the radius rotates about its center and length, then watering coverage for other shapes such as rectangles, parallelograms, trapezes, as well as other odd shapes, may be achieved. On top of the deflector 300, the cog-wheel 320 is shown and described with respect of FIG. 3A above.

Figure 3C:
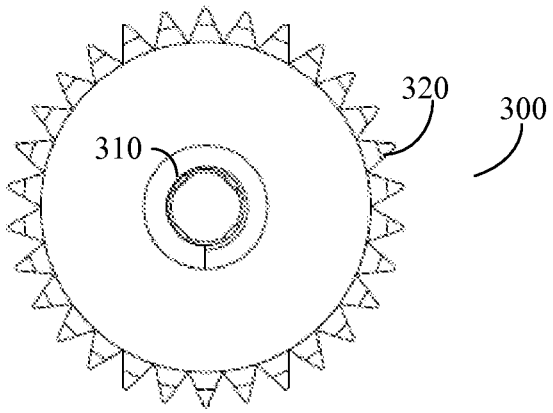
FIG. 3C is a schematic diagram of a bottom view of a deflector having an uneven surface according to an embodiment disclosed herein.
Figure 3D:
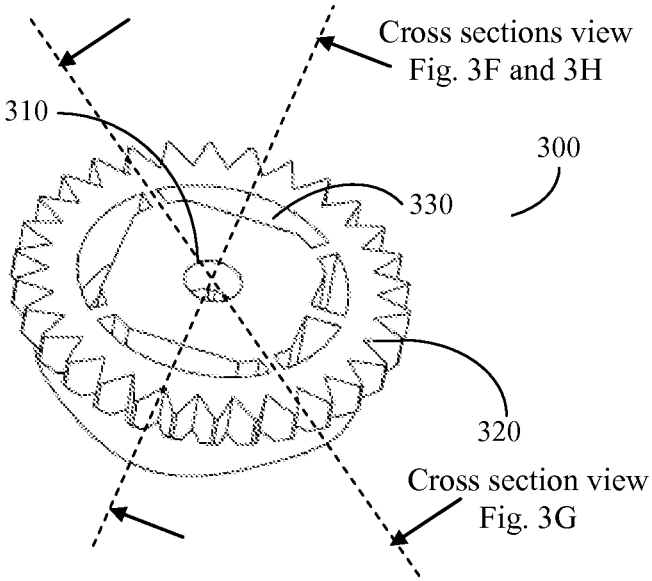
FIG. 3D is an isometric view of a deflector having an uneven surface according to an embodiment disclosed herein.
Figure 3E:
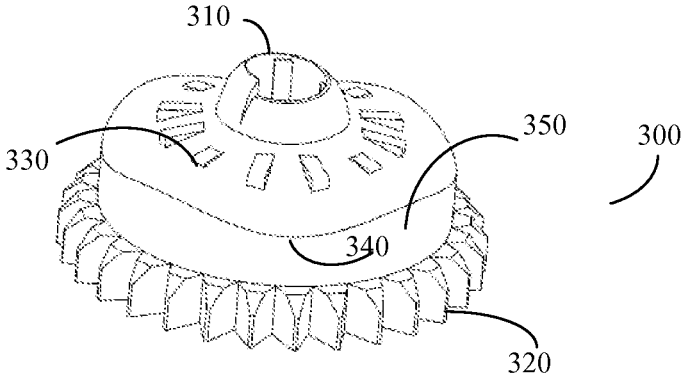
FIG. 3E is an isometric view of a bottom view of a deflector having an uneven surface according to an embodiment disclosed herein.
Figure 3F:
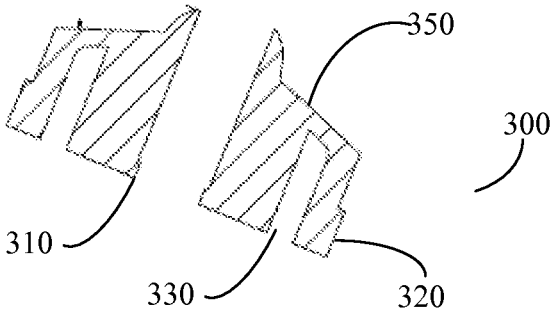
FIG. 3F is a cross section view of a peak angle of a deflector having an uneven surface according to an embodiment disclosed herein.
Figure 3G:
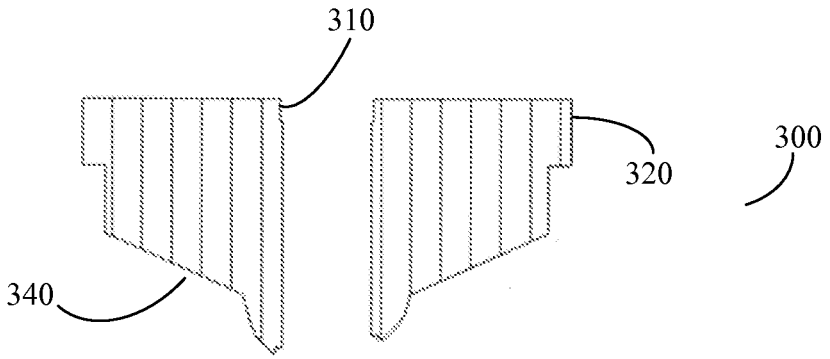
FIG. 3G is a cross section view of a deep-angle of a deflector having an uneven surface according to an embodiment disclosed herein.
Figure 3H:
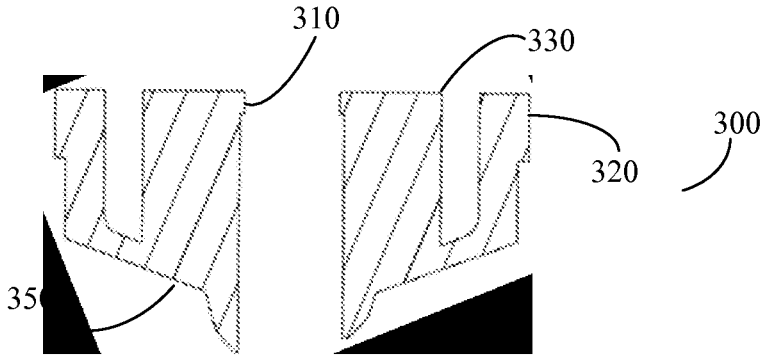
FIG. 3H is a cross section view of a peak angle of a deflector having an uneven surface according to an embodiment disclosed herein.

FIG. 3C depicts an exemplary and non-limiting schematic diagram of a bottom view of the deflector 300 having an uneven surface according to one embodiment. FIG. 3D depicts an exemplary and non-limiting isometric view of the deflector 300 having an uneven surface according to one embodiment. FIG. 3E depicts an exemplary and non-limiting isometric view of a bottom of the deflector 300 according to one embodiment of the invention. The deep angle 340 and peak angle 350 of the deflector's 300 surface are clearly shown in FIG. 3E. FIG. 3F and FIG. 3H depict an exemplary and non-limiting cross section view of the peak angle 350 of the deflector 300 that has an uneven surface. FIG. 3G depicts an exemplary and non-limiting cross section view of a deep-angle 340 of the deflector 300 that has an uneven surface according to an embodiment of the invention.

Figure 4A:
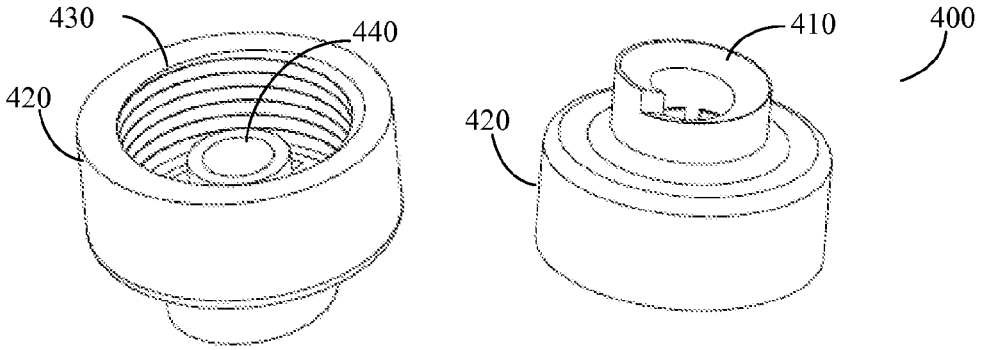
FIG. 4A depicts isometric views of a two-diameter tubular body according to an embodiment disclosed herein.
Figure 4B:
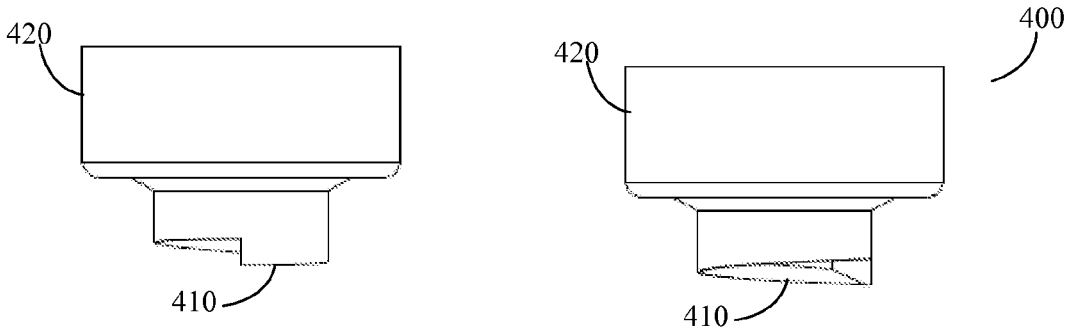
FIG. 4B is a schematic diagram of a two-diameter tubular body according to an embodiment disclosed herein.
Figure 4C:
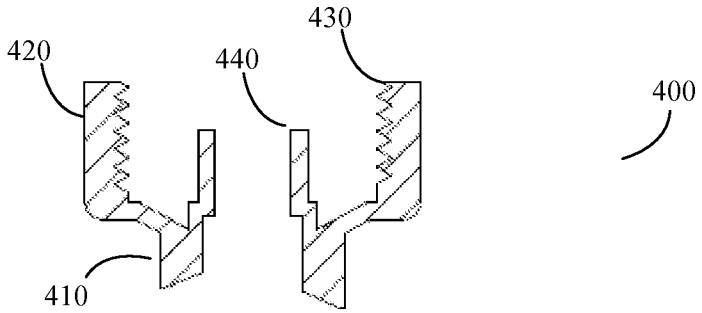
FIG. 4C is a cross section view of a two-diameter tubular body according to an embodiment disclosed herein.

FIGS. 4A through 4C depict exemplary and non-limiting views of a two-diameter tubular body 400 constructed according to various embodiments. The two-diameter tubular body 400 is designed to allow liquid to flow from a pipe to the deflector 300.

FIG. 4A depicts exemplary and non-limiting isometric views of the two-diameter tubular body 400 according to an embodiment, comprising a top portion that has a spiral shape 410 and a lower portion 420 that has an internal screw thread (ribs) 430 to be attached to a water source such as a tube, a pipe, and the like. The spiral shape 410 allows for the 0 to 360 degrees adjustment coverage and is designed to prevent spraying coverage at a fixed angle (e.g., only 360 degrees). The diameter of the lower portion 420 is larger than the top portion. The lower portion of the two-diameter tubular body 400 has a threaded hole 440 for insertion of a screw to attach all the portions of the watering device. FIG. 4B depicts an exemplary and non-limiting schematic diagram of the two-diameter tubular body 400. FIG. 4C depicts an exemplary and non-limiting schematic diagram of a cross section view of the two-diameter tubular body 400.

Figure 5A:
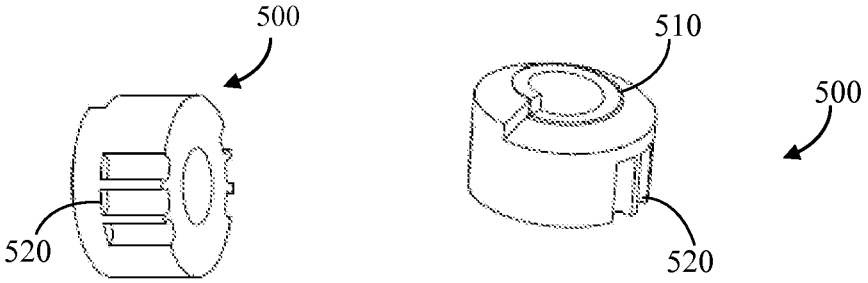
FIG. 5A is an isometric view of a spiral sector according to an embodiment disclosed herein.
Figure 5B:
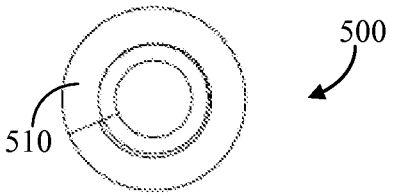
FIG. 5B is a schematic diagram of a spiral sector according to an embodiment disclosed herein.
Figure 5C:
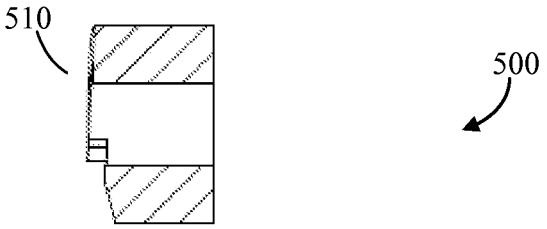
FIG. 5C is a cross section view of a spiral sector according to an embodiment disclosed herein.

FIGS. 5A through 5C depict exemplary and non-limiting views and cross-sections of a spiral sector object 500. The spiral sector object 500 provides an adjustable spray orifice to adjust the irrigation pattern from an angle of 0 degrees up to approximately 360 degrees. FIG. 5A depicts exemplary and non-limiting isometric views of the spiral sector and cuts of object 500 that includes a spiral sector 510 and one or more parallel cuts 520 for the grip of the object 500 and to setup the starting point of the orifice from 0°-360° relative to the deflector 300. In one embodiment, there are 6 parallel cuts, 3 on each side of the object 500. The spiral sector 510 allows the adjustment of the orifice to set the converging angle from 0° to approximately 360° relative to object 400 and its 410 spiral sector. The parallel cuts 520 allow setting up the starting point of the orifice 0° relative to the deflector 300 and its 395 protrusions (clearly shown in FIG. 12A). The starting point defines the point from where the 0° of the orifice starts relative to the deflector 300

FIG. 5B depicts an exemplary and non-limiting schematic diagram of the spiral sector 510 of the spiral sector object 500.

FIG. 5C depicts an exemplary and non-limiting cross section assembly view of the spiral sector 510 of the spiral sector object 500.

Figure 6:
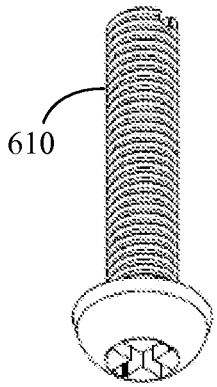
FIG. 6 is an isometric view of a screw with a conical head that can be utilized in an embodiment of a watering device disclosed herein.

FIGS. 7A through 7D depict exemplary and non-limiting views and cross-sections of a watering device 700 constructed according to one embodiment. The watering device 700 includes the deflector 300, the two-diameter tubular body 400, and the spiral sector object 500, that are assembled together with a screw 610. In one embodiment, the screw 610 has a conical head as schematically illustrated in FIG. 6.

Figure 7A:
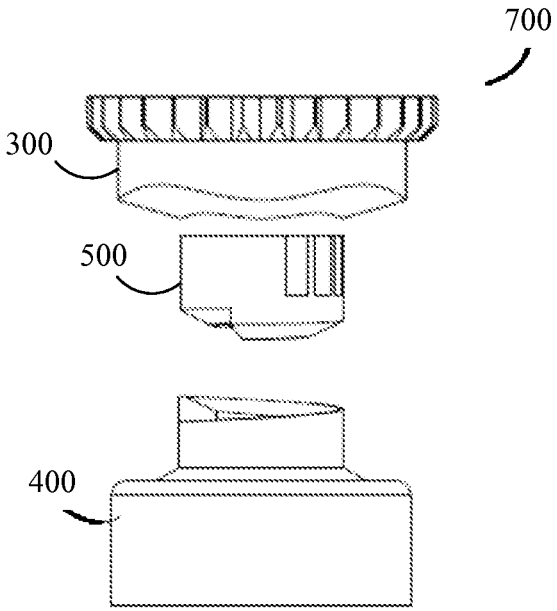
FIG. 7A is an exploded view of a watering device according to an embodiment disclosed herein.

FIG. 7A depicts an exemplary and non-limiting an exploded view diagram of the watering device 700 constructed according to one embodiment. As shown in FIG. 7A, the watering device includes, at its base, the two-diameter tubular body 400 having placed thereon the spiral sector object 500. On top of the spiral sector object 500, the deflector 300 is assembled. These elements are screwed together by means of the screw 610 (not shown in FIG. 7A).

Figure 7B:
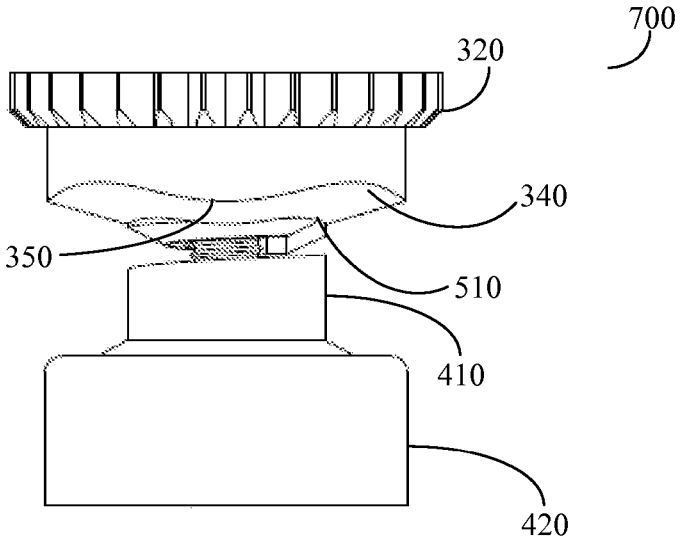
FIG. 7B is a schematic diagram of the watering device.

The structure of the watering device 700 is shown in greater detail in FIG. 7B. The lower bigger portion 420 of the two-diameter tubular body 400 serves as the base of the watering device 700. The spiral sector 510 is connected between the surface of the reflector 300 (shown by the deep and peak angles 340 and 350), and the top portion of two-diameter tubular body 400 having the spiral shape 410. The top of the watering device 700 is the cog-wheel 320 of the watering device 700.

Figure 7C:
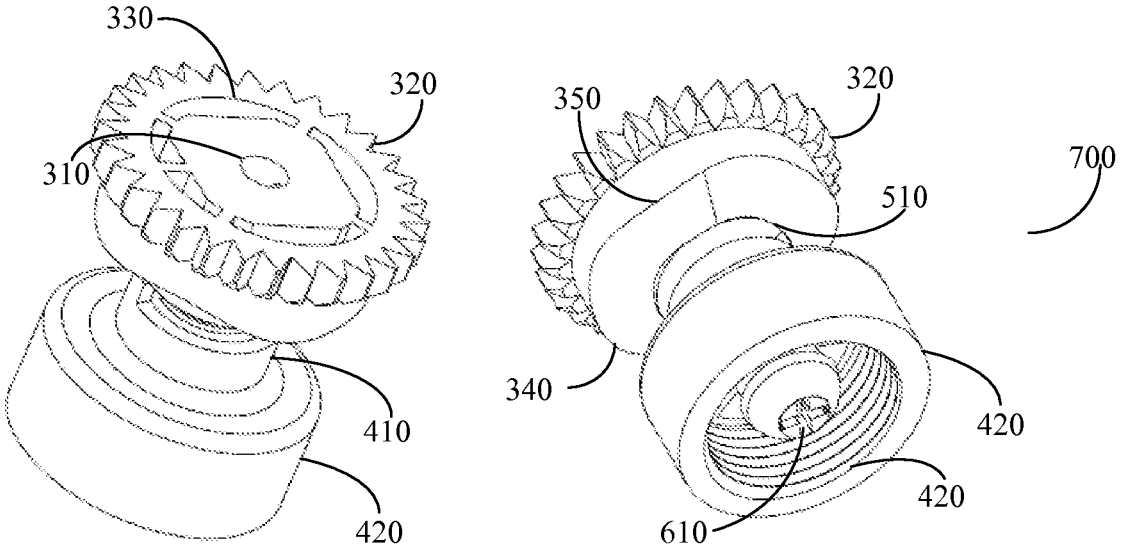
FIG. 7C is an isometric view of a watering device according to an embodiment disclosed herein.
Figure 7D:
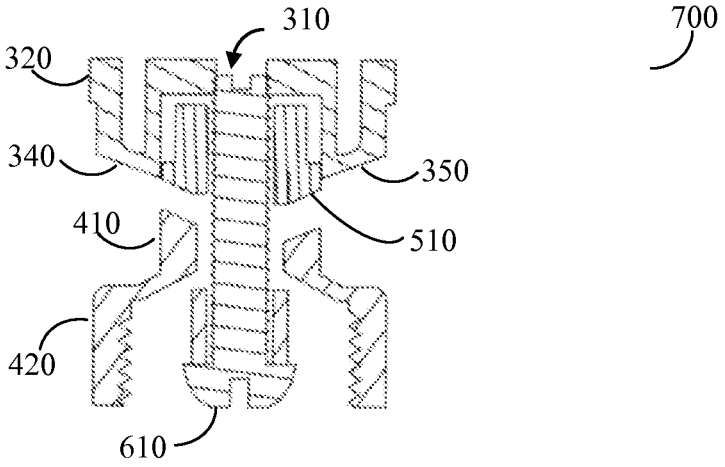
FIG. 7D is a cross section view of the watering device.
Figure 8:
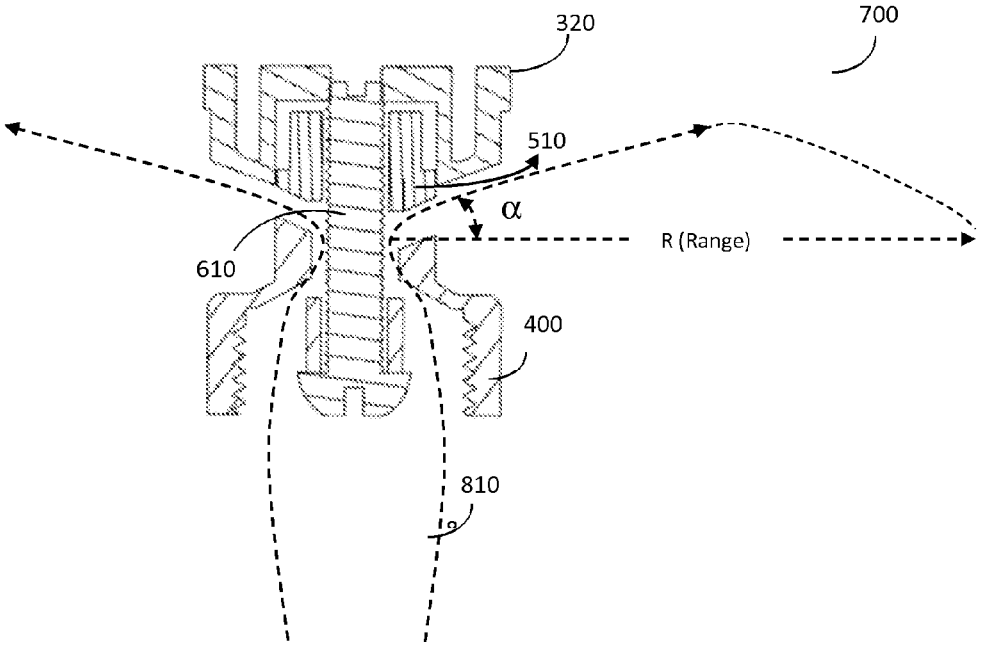
FIG. 8 is a cross section view of the watering pattern of the watering device constructed according to one embodiment.

FIG. 7C depicts exemplary and non-limiting isometric views of the watering device 700 according to one embodiment of the invention. FIG. 7D depicts an exemplary and non-limiting cross section assembly view of the watering device 700. As shown in FIG. 7D, the screw 610 is utilized to connect the elements of the watering device 700. The screw 610 is screwed between the thread 430 (FIG. 4B) of the body 400 and the screw hole 310 located in the middle of the top part of the deflector 300, and inserted through the spiral sector 510. FIG. 8 depicts an exemplary and non-limiting cross section view of the watering device 700 utilized to describe the operation of the watering device 700 according to one embodiment. Water 810 flows through the two diameter tubular body 400 that is screwed on a tubular pipe (not shown). The water hits the deflector's 300 surfaces (340, 350 or any surface there between) and deflects outwards and an angle $\alpha$. That angle $\alpha$ determines the radius to which the water can reach. Tables 1 and 2 provided below as non-limiting examples for determining the irrigation pattern according to one embodiment of the invention.

In an embodiment, the angles $\alpha$1 and $\alpha$2, listed in Tables 1 and 2 correspond to the peak angle 350 and the deep angle 340, respectively. The peak angle ($\alpha$1) determines the "width" distance for a rectangular irrigation or the "Radius" for an irrigation area having a square shape. The deep angle ($\alpha$2) determines the "Diagonal" distance of the irrigation area. It should be noted that in FIG. 8, the angle $\alpha$ is the generic symbol of the specific angle $\alpha$1 or $\alpha$2 depending on the cross section per FIGS. 3F, 3G, and 3H.

Figure 9A:
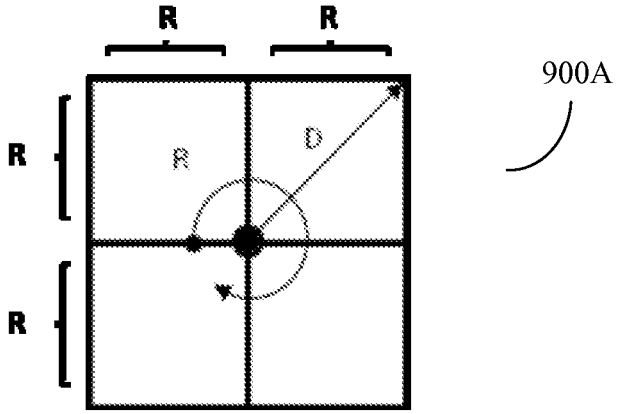
FIGS. 9A and 9B are schematic diagrams of the irrigation patterns as determined by different starting points according to various embodiments disclosed herein.
Figure 9B:
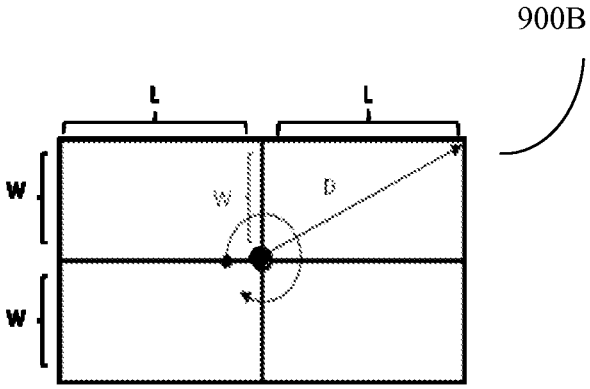

Thus, different deflection angles ($\alpha$1, $\alpha$2) result in a different distance and different coverage areas 900A and 900B, as shown in FIG. 9A (respective of Table 1) and FIG. 9B (respective of Table 2).

TABLE 1

| Irrigation Shape | Dimension | Angle | [°] | Distance | Area |
|---|---|---|---|---|---|
| Square | Radius (R) | α1 | 10 | 2.08 | 4.17^2 = 17.9 |
| | Diagonal (D) | α2 | 14.4 | 2.94 | |

TABLE 1-continued

| Irrigation Shape | Dimension | Angle | [°] | Distance | Area |
|---|---|---|---|---|---|
| Square | Radius (R) | α1 | 15 | 3.05 | 6.1^2 = 37.16 |
| | Diagonal (D) | α2 | 22.5 | 4.31 | |
| Square | Radius (R) | α1 | 22.5 | 4.31 | 8.62^2 = 74.32 |
| | Diagonal (D) | α2 | 45 | 6.10 | |

TABLE 2

| Irrigation Shape | Dimension | Angle | [°] | Distance | Area |
|---|---|---|---|---|---|
| Rectangle | Width (W) | α1 | 10 | 2.08 | 4.17 × 6.02 = |
| | Diagonal (D) | α2 | 18.45 | 3.66 | 25.09 |
| | Length (L) | | | 3.01 | |
| Rectangle | Width (W) | α1 | 15 | 3.05 | 6.1 × 10.56 = |
| | Diagonal (D) | α2 | 45 | 6.10 | 64.37 |
| | Length (L) | | | 5.28 | |

Merely for the purpose of illustration, the factors used to determine a square irrigation area is described hereinafter. With this aim, the surface angles (i.e., deep and peak angels 340 and 350) of the deflector 300 may be determined by the following non-limiting equation:

$$R = \frac{V_0^2 * \sin(2a)}{g}$$

when $$\alpha = \alpha_1$$

$$PSI = 0.000145 * 0.5C * D * V_0^2$$

$$x = 0.000145 * C * D$$

$$C = \text{Drag}$$

$$D = \text{Water density } 998.2 \text{ Kg/m}^3$$

where, α represents the angles of deflection, R is the radius coverage of the watering device, and $V_0$ is the initial velocity of the water droplet which depends on the water pressure, i.e., the higher the pressure, the higher the velocity, and vice versa.

It should be noted that for the creation of a square irrigation area there would be four angles of $\alpha_1$ four of $\alpha_2$ and varying angles in between them. If a different number were chosen, such as five of each, a pentagon would have been created, and so on and so forth. It should also be readily understood that if $\alpha_1$ was 10 degrees and $\alpha_2$ was 18.45 degrees a rectangle having a shape of 4×6 meters would be created with the appropriate equation.

In another embodiment of the invention, the surface angles of the deflector 300 may be determined by the following equation, where α represents the angles of deflection, but not by way of limitation:

$$R = \frac{(PSI/x) * \sin(2a)}{g}$$

when $$\alpha = \alpha_1$$

$$PSI = 0.000145 * 0.5C * D * V_0^2$$

$$x = 0.000145 * C * D$$

$$C = \text{Drag}$$

$$D = \text{Water density } 998.2 \text{ Kg/m}^3$$

In one embodiment, as shown in FIG. 8, the deep angle and the maximum range represents the square corners; and the peak angle and the minimum range represents the shortest distance from the sprinkler to the square sides. It should be noted that the deep angle determines maximum distance from the deflector while the peak angle determines maximum distance from the deflector.

By twisting the deflector 300, the water injunction can be determined and realigned and the irrigation pattern will change accordingly. The irrigation pattern and coverage area also depend on the water pressure.

Figure 10:
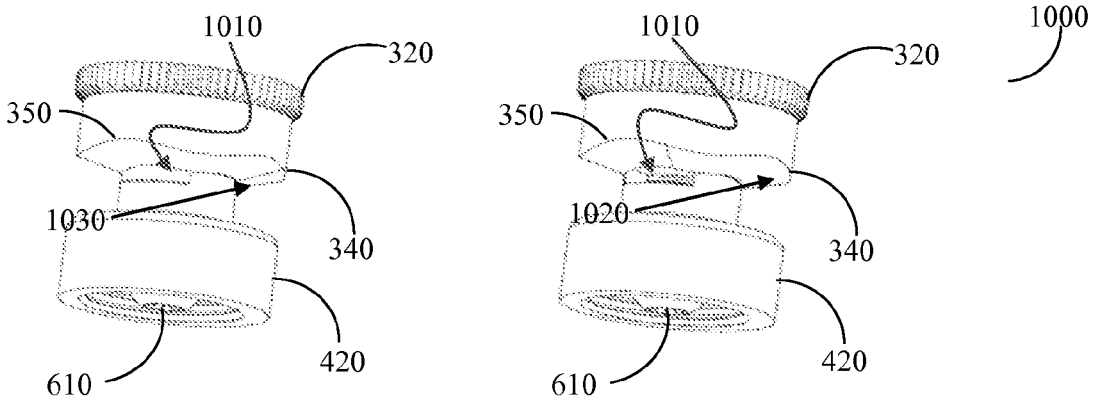
FIG. 10 is a isometric diagram of the closed and opened orifice positions of the watering device.

FIG. 10 depicts an exemplary and non-limiting isometric diagram of the closed and open orifice positions of a watering device 1000 according to one embodiment. The orifice is formed by the connection of the spiral sector 510 with the spiral shape 410. That is, the spiral sector 510 with the spiral shape 410 move relative to each other, thereby an orifice is created from zero to max opening, i.e. from 0 to 360 degrees. The orifice 1010 can be easily aligned from an open position 1020 to a closed position 1030. The amount the orifice opens determines the angle that the liquid passes through and hence determines the angle of irrigation coverage from 0 to 360 degrees.

Figure 11:
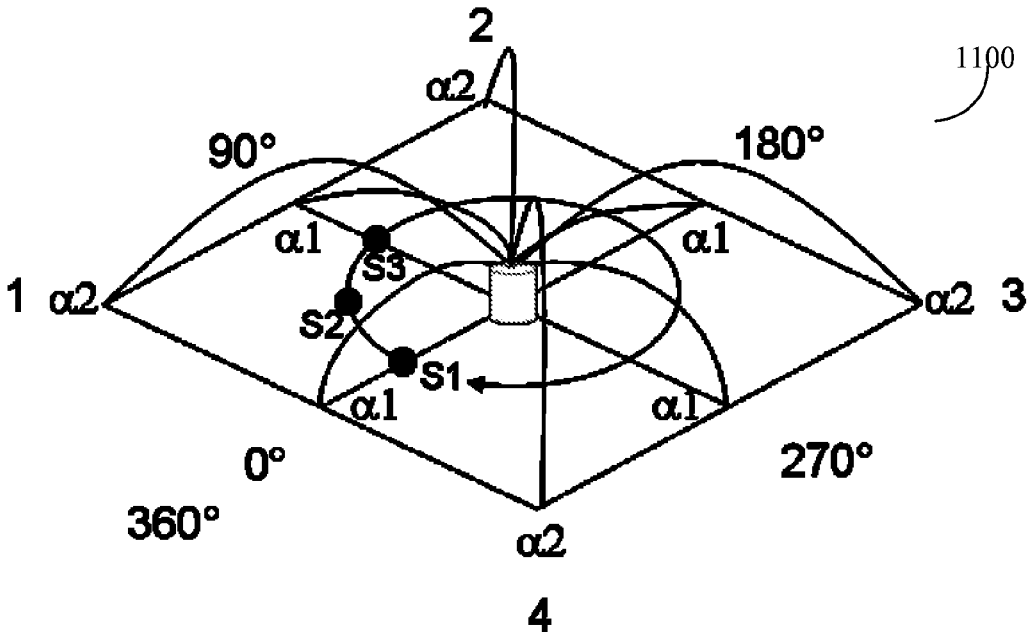
FIG. 11 is a diagram simulating an irrigation pattern that can be achieved using the watering device constructed according to one embodiment.

FIG. 11 depicts an exemplary and non-limiting simulation of the irrigation pattern 1100, where the starting point can be easily adjusted and realigned and the irrigation pattern is determined accordingly. By twisting the deflector 300 of the watering device (e.g., device 700), the user can set the angle of irrigation coverage from 0 to 360 degrees. For example, FIG. 11 shows four stopping points, 1, 2, 3 and 4, where the irrigation surfaces change from 0° to 360° degrees, according to each stopping point.

Figure 12A:
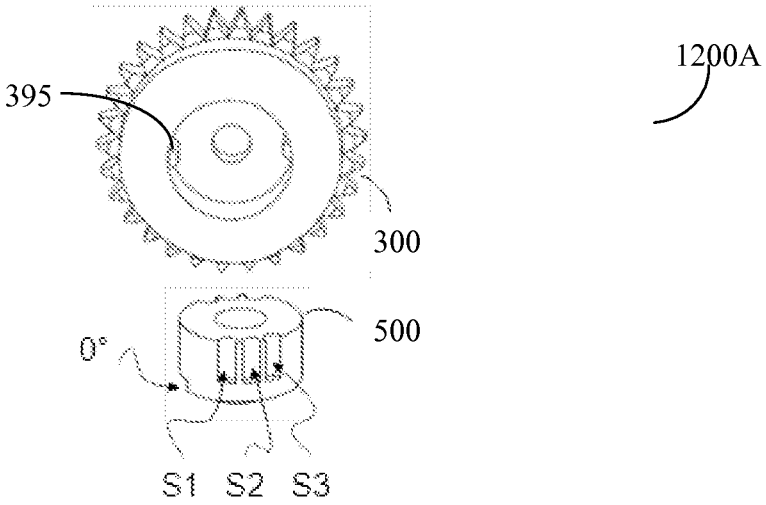
FIG. 12A is a schematic diagram of both the deflector and the spiral sector illustrating three starting points utilized to determine irrigation patterns of the watering device.
Figure 12B:
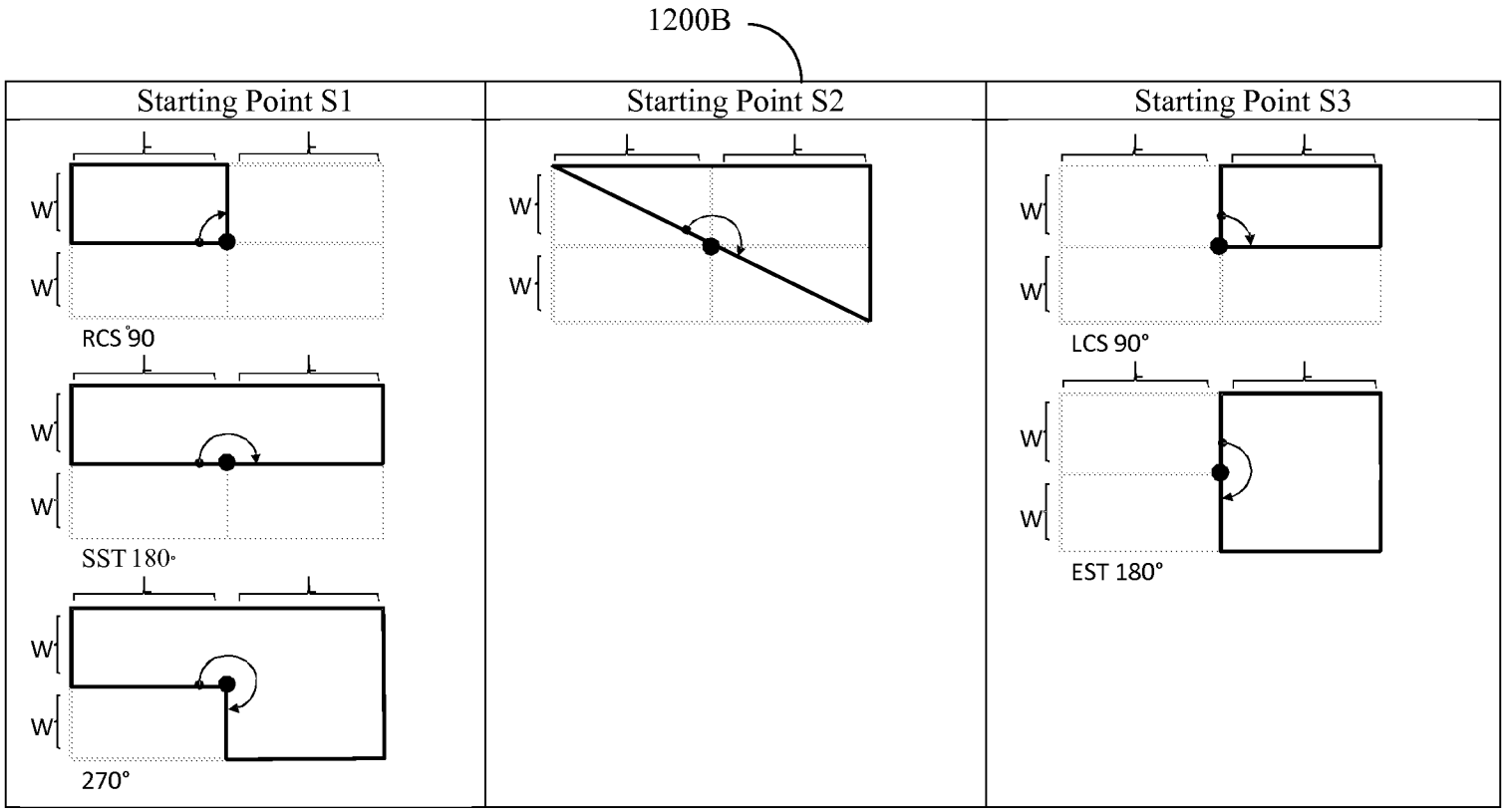
FIGS. 12B and 12C depict diagrams simulating the irrigation patterns respective of different starting points of the watering device.
Figure 12C:
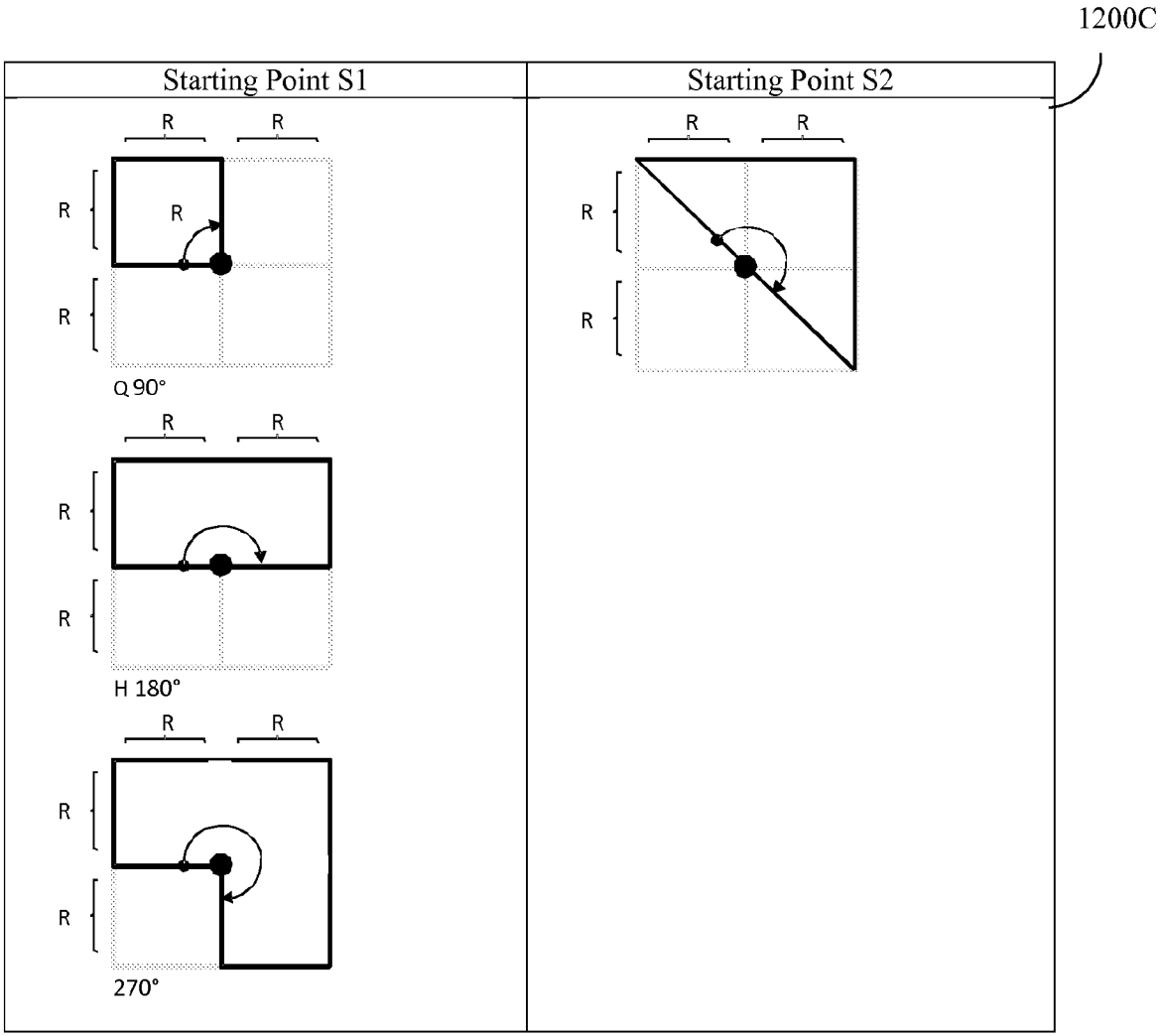

FIG. 12A depicts an exemplary and non-limiting schematic diagram 1200A of both the deflector 300 and the spiral sector object 500 wherein S1, S2 and S3 shows examples of three starting points of the watering device which are used in irrigation patterns. FIGS. 12B and 12C depict an exemplary and non-limiting simulation 1200B and 1200C of the irrigation pattern respective of different starting points S1, S2 and S3 of the watering device. By rotating the object 500 relative to the deflector 300, a user can set the starting point of the watering device for the 0° to 360 degrees. For example, FIG. 12A shows three starting points: S1, S2, and S3 where according to each starting point the irrigation coverage changes according to FIGS. 12B and 12C, thereby providing flexibility to the installation of the watering device. It should be noted that as the pattern of the irrigated area is rectangular and not circular, then the starting point of where to start the coverage relative to the deflector object 300 is critical. As can be clearly noticed in FIGS. 12B and 12C the covered area's pattern can vary depending on the starting point.

Figure 13:
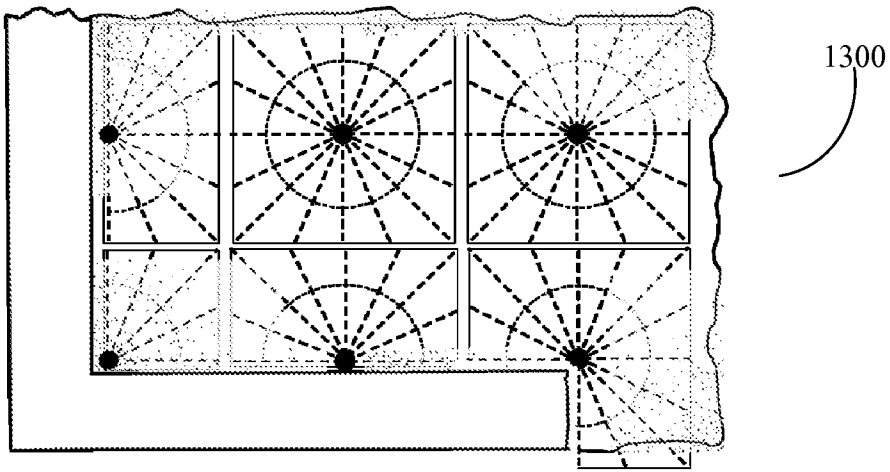
FIG. 13 is a schematic diagram of the irrigation pattern that demonstrates the rectangular coverage spraying of a lawn garden according to one embodiment.

FIG. 13 depicts an exemplary and non-limiting schematic diagram 1300 of the irrigation pattern that demonstrates the rectangular coverage spraying of a lawn garden according to an embodiment of the invention.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention. Furthermore, the foregoing describes the invention in terms of embodiments foreseen by the inventor for which an enabling description was available, notwithstanding that insubstantial modifications of the invention, not presently foreseen, may nonetheless represent equivalents thereto.

What we claimed is:

1. A watering device for irrigation of non-circular areas, comprising:

a deflector having an uneven curved surface designed to cause liquid meeting the deflector to reach a distance that changes respective of the uneven surface to cover an irrigation area, wherein the uneven curved surface is a lateral surface comprising a plurality of peak angles and a plurality of deep angles, wherein the plurality of peak angles and the plurality of deep angles are calculated to cause irrigation of the non-circular area;

a cog-wheel attached to a top surface of the deflector;

a spiral sector object connected to the deflector and providing an adjustable spray orifice for adjusting an irrigation pattern of the watering device; and a two-diameter tubular body connected to the spiral sector object and allowing the liquid to flow from a pipe to the uneven curved surface of the deflector.

2. The watering device of claim 1, further comprises:

a screw having a conical head, wherein the screw is utilized to fasten the deflector to the spiral sector object and the two-diameter tubular body.

3. The watering device of claim 1, wherein the number of each of the plurality of peak angles and the plurality of deep angles determines a shape of the irrigation area being covered by the watering device.

4. The watering device of claim 3, wherein the number of each of the plurality of peak angles and the plurality of deep angles required covering a rectangular irrigation area is four.

5. The watering device of claim 3, wherein the plurality of peak angles and the plurality of deep angles are configured to create the shape of the irrigation area as any one of: a parallelogram, a trapeze, a pentagon, and a hexagon.

6. The watering device of claim 3, wherein the plurality of peak angles and the plurality of deep angles further creates a semi non-circular irrigation area.

7. The watering device of claim 1, wherein the spiral sector object further comprises:

a plurality of parallel cuts for setting a starting point to the watering device, wherein the starting point defines the irrigation pattern from an angle of 0 degrees up to approximately 360 degrees relative to the deflector; and a spiral sector for adjusting an opening of an orifice from an angle of 0 degrees up to approximately 360 degrees, wherein the adjustment of the opening is relative to a movement of the two-diameter tubular body and the spiral sector.

8. The watering device of claim 7, wherein the two-diameter tubular body further includes:

a top portion having a spiral shape allowing in part the adjustment of the orifice opening;

a lower portion having an internal screw thread to fasten the watering device to the pipe; and a threaded hole for insertion of a screw.

9. The watering device of claim 1, wherein the uneven surface gradually inclines.

10. The watering device of claim 1, wherein the deflector further comprises:

at least one additional uneven curved surface at a step from the uneven curved surface.

11. A watering device for irrigating of non-circular areas, comprising:

a deflector having a lateral surface determined by a radius that changes around a height axis of the deflector, the lateral surface having at least a first angle that determines a first irrigation distance from the center of the deflector for deflection of water hitting the deflector and a second angle that determines a second irrigation distance from the center of the deflector for deflection of water hitting the deflector, wherein the lateral surface comprises a plurality of peak angles and a plurality of deep angles, wherein the plurality of peak angles and the plurality of deep angles are calculated to cause irrigation of the non-circular area;

a cog-wheel attached to a top surface of the deflector; and an adjustable rectangular spray orifice for adjusting a non-circular irrigation pattern from an angle 0 degrees up to approximately 360 degrees.

12. The watering device of claim 11, wherein the deflector has a cone-shaped structure.

13. The watering device of claim 11, wherein the first angle is an angle larger than the second angle.

14. The watering device of claim 11, wherein the first irrigation distance and the second irrigation distance determine coverage of the irrigation area.

* * * * *